US007169215B2

(12) United States Patent
Shacham-Diamand et al.

(10) Patent No.: US 7,169,215 B2
(45) Date of Patent: Jan. 30, 2007

(54) COPPER MOLYBDENUM ELECTROLESS DEPOSITION PROCESS AND MATERIALS

(75) Inventors: Yossi Shacham-Diamand, Zichron-Ya'acov (IL); Yelena Sverdlov, Netanya (IL)

(73) Assignee: Ramot At Tel Aviv University Ltd., Tel Aviv (IL)

( * ) Notice: Subject to any disclaimer, the term of this patent is extended or adjusted under 35 U.S.C. 154(b) by 277 days.

(21) Appl. No.: 10/750,716

(22) Filed: Jan. 2, 2004

(65) Prior Publication Data

US 2005/0145133 A1 Jul. 7, 2005

(51) Int. Cl.
*C23C 18/48* (2006.01)

(52) U.S. Cl. ..... 106/1.23; 106/1.26

(58) Field of Classification Search ..... 106/1.23, 106/1.26

See application file for complete search history.

(56) References Cited

U.S. PATENT DOCUMENTS

| | | | | |
|---|---|---|---|---|
| 3,650,777 | A * | 3/1972 | Schneble et al. | 427/443.1 |
| 4,150,171 | A | 4/1979 | Feldstein | 427/558 |
| 4,209,331 | A | 6/1980 | Kukanskis et al. | 106/1.23 |
| 5,203,911 | A * | 4/1993 | Sricharoenchaikit et al. | 106/1.26 |
| 5,306,336 | A * | 4/1994 | Martyak et al. | 106/1.23 |
| 5,674,787 | A | 10/1997 | Zhao et al. | 438/627 |
| 5,695,810 | A | 12/1997 | Dubin et al. | 438/643 |
| 6,908,504 | B2 * | 6/2005 | Chebiam et al. | 106/1.22 |
| 2004/0038073 | A1 * | 2/2004 | Chebiam et al. | 428/668 |
| 2005/0147762 | A1 * | 7/2005 | Dubin et al. | 427/437 |

OTHER PUBLICATIONS

P.C. Andricacos, Damascene Copper Electroplating for Chip Interconnect, IBM J. .Res. Develop 42 (1998) 567-573, no month available.

Y. Shacham-Diamand, V. Dubin, and M. Angyal, Copper Electroless deposition for ULSI, Thin Solid Films, 262, (1995) 93-103, no month available.

Vashkjalis A., Demontaine Q. Study of Cu electroless deposition process using NaBH4 as a reducing agent, Lithuanian Academy of Sciences publication, series B, vol. 4(95), pp. 11-16, 1976, no month available.

Molenaar A., J. of the Electrochem. Soc., 1982 vol. 129, N 9, p. 1917-1921, no month available.

Shalkauskas M., Vashkjalis A. Electroless deposition of metals on plastics, L., J. Chemistry, 1985, pp. 95-113, no month available.

Tetsuya Ogura, M. Malcomson, Q. Fernando, Mechanism of Copper Deposition in Electroless plating, Langmuir 1990, 6, pp. 1709-1710, no month available.

F.P. Pearlstein and R.F.Weightman, Electroless Deposition of Silver Using Dimethylamine Borane, Plating, Feb. 1974, pp. 154-157.

Y. Shacham-Diamand, and V. Dubin, J. of Microelectronics Engineering, 33, pp. 47-58, 1997.

Yosi Shacham-Diamand and Sergey Lopatin, Journal of Microelectronics Engineering, vol. 37/38, pp. 77-88, 1997, no month available.

(Continued)

*Primary Examiner*—Helene Klemanski
(74) *Attorney, Agent, or Firm*—Abelman, Frayne & Schwab

(57) ABSTRACT

Materials and methods are described for electroless deposition of copper molybdenum. An aqueous bath composition for the electroless deposition of copper molybdenum includes;

a soluble source of copper ions, a soluble source of molybdenum ions, and a reducing agent comprising boron, wherein the composition is adapted to electrolessly produce a copper molybdenum deposit.

49 Claims, 8 Drawing Sheets

OTHER PUBLICATIONS

E. Gileadi, Electrode Kinetics, VCH Publishers, New York 1993, no month available.

E. Podlaha and D. Landolt, A Mathematical Model Describing the Electrodeposition of Ni-Mo Alloys, J.of the Electrochem. Soc., vol. 143, pp. 893-899, 1996, no month available.

E. Podlaha and D. Landolt, Molybdenum Alloys with Nickel, Cobalt and Iron, J. of the Electrocem. Soc. vol. 144, pp. 1672-1680, 1997, no month available.

E. Podlaha and D. Landolt, An Experimental Investigation of Ni-Mo Alloys, J. of the Electrochem. Soc., vol. 143, pp. 885-892, 1996, no month available.

Y.Shacham-Diamand and Y.Sverdlov, Electroless Cu alloys for ULSI applications, in Proceedings of the Advanced Metallization Conference 2001 (AMC 2001), p. 67-72, Montreal, Canada, Oct. 8-11, 2001.

Y.Shacham-Diamand, A.Inberg, Y.Sverdlov and N.Croitoru, Electroless Silver and Silver with Tungsten Thin Films for Microelectronics and Microelectromechanical System Applications, J.of the Electrochemical Society, 147 (9) 3345-3349, Jan. 2000.

K.M. Gorbunova, A.A. Nikiforova, G.A. Sadakov, V.P. Moiseev, M.V. Ivanov, "Physical-chemical origins of chemical cobalt deposition", "Science" publication, Moscow, pp. 195-201, 1974, no month available.

F.Ajogin, M.Belenki, I.Gall, "Galvanotechnique", "Metallurgy" publication, Moscow, pp. 170-178, 538-540, 1987, no month available.

Y.Shacham-Diamand, A.Inberg, Y.Sverdlov, V.Bogush, N.Croitoru, H.Moscovich, A.Freeman, Electroless process for micro-and nanoelectronics, J.Electrochimica Acta 48 (2003) 2987-2996, no month available.

* cited by examiner

Thickness of electroless deposited CuMo films as a function of time
Electrolyte Cu-citr. pH=7.7-7.9

COPPER MOLYBDENUM ELECTROLESS DEPOSITION PROCESS AND MATERIALS

FIELD OF THE INVENTION

The present invention relates generally to metallic deposition materials and processes, and more specifically to materials and processes for metallic electroless deposition.

BACKGROUND OF THE INVENTION

Metallic diffusion and/or drift between different metallic layers, or metallic and semiconductor layers induce changes over time in the properties of the layer into which diffusion and/or drift has occurred. These properties include electrical, mechanical, thermal, visual, physical and chemical properties. There is great importance to many industries to produce products having both constant properties over time and high reliability. These industries include, but are not limited to semiconductor, microelectronics, electro-finishing, aeronautic, space and motor industries. Products requiring high reliability include, for example, semiconductor chips, ULSI products, jewelry, nuts and bolts, and airplane wings and car parts. Typically, the smaller the product, the more pronounced an effect of a localized change in a property of a layer.

In the semiconductor industry, the diffusion of metals into adjacent layers is well documented. For example, copper diffuses into silicon materials. To prevent such diffusion, a barrier layer between the copper and silicon may be deposited (U.S. Pat. No. 5,695,810 to Dubin et al.).

The microelectronics industry constantly aims to reduce the size of components and the distance between interconnects, yet, simultaneously, tries to increase the number of electronic features per unit area. Thus, there is an increasing requirement for more accurate and well-controlled metal deposition techniques. For example, with decreasing size of copper/$SiO_2$ interconnects, standard processes known in the art for metal deposition cannot typically meet the new requirements for precision. There is therefore an urgent need for better designed processes, materials and manufacturing methods for metal deposition.

One of the concerns in manufacturing and processing copper, amongst other metals, is its corrosion, before and after Chemical-Mechanical Polishing (CMP), which may induce deterioration in the electrical and mechanical properties of the copper. Another concern is the migration of copper onto the inter-level dielectric and the silicon substrate (see U.S. Pat. No. 5,674787 to Zhao, et al.) Copper contamination in inter-level dielectrics weakens the dielectrics' mechanical properties and reduces electrical reliability. Copper is also a deep level dopant in silicon, which may lower the minority carriers lifetime and may enhance leakage currents to significant levels.

Copper has poor adhesion to most dielectrics that are used in ULSI manufacturing, such as, but not limited to, $SiO_2$, SiOF, polyimide and low-K dielectrics. Therefore, the implementation of a copper encapsulation method is desirable. One possible solution is to wrap the Cu lines with special thin metallic cladding that serves as a corrosion resistance layer; a diffusion barrier; and as a adhesion promoter.

There are many materials that are known to be good barrier to diffusion. Usually they are refractory metals, such as Ta, W and Mo, or refractory metal nitride thin films such as TiN, TaN, and $W_xN_y$. The layers can be deposited by conventional physical vapor deposition (PVD), chemical vapor deposition (CVD) or Atomic Layer Chemical Vapor Deposition (ALCVD).

Alternative methods for depositing barriers are electroplating and electroless (autocatalytic) deposition of metallic alloys (see U.S. Pat. No. 4,209,331 to Kukanskis, et al.).

There is therefore an urgent need to develop novel materials and methods for metallic deposition which overcome diffusion, drift and migration of metallic ions.

SUMMARY OF THE INVENTION

It is an object of some aspects of the present invention to provide improved materials and processes for providing a barrier layer for metallic layers, such as copper.

In preferred embodiments of the present invention, improved materials and processes are provided for the electroless deposition of copper molybdenum, substantially devoid of alkali metal ions and alkaline earth metal ions.

In further preferred embodiments of the present invention, methods and materials for electroless deposition of copper molybdenum, substantially devoid of alkali metal ions and alkaline earth metal ions, on a single silicon crystal, on a thermal oxide on silicon, and on thin films of copper and cobalt on silicon substrates are provided.

In yet further preferred embodiments of the present invention metallic deposits of copper molybdenum are provided, wherein the deposits are substantially alkali metal free and alkaline earth metal free.

There is thus provided in accordance with a preferred embodiment of the present invention an aqueous bath composition for the electroless deposition of copper molybdenum, including, in addition to water:

a soluble source of copper ions, a soluble source of molybdenum ions, and a reducing agent including boron, wherein the composition is adapted to electrolessly produce a copper molybdenum deposit having a resistivity of less than 30 microohm.cm.

Also, in accordance with a preferred embodiment of the present invention, there is provided a composition according wherein the copper molybdenum deposit has a resistivity of less than 10 microohm.cm.

Additionally, in accordance with a preferred embodiment of the present invention, there is provided a composition, wherein the composition is substantially devoid of alkali metals and alkaline earth metals.

Further, in accordance with a preferred embodiment of the present invention, there is provided a composition wherein the soluble source of copper ions includes copper sulfate.

Furthermore, in accordance with a preferred embodiment of the present invention, there is provided a composition, wherein the copper sulfate includes copper sulfate pentahydrate ($CuSO_4.5H_2O$) at a concentration of 2–10 g/l.

Yet further, in accordance with a preferred embodiment of the present invention, there is provided a composition, wherein the copper sulfate pentahydrate is at a concentration of 3–5 g/l.

Still further, in accordance with a preferred embodiment of the present invention, there is provided a composition, wherein the soluble source of molybdenum ions includes molybdic acid monohydrate ($H_2$ $MoO_4.H_2O$).

Also, in accordance with a preferred embodiment of the present invention, there is provided a composition, wherein the wherein molybdic acid monohydrate is present at a concentration of 0–5 g/l.

Further, in accordance with a preferred embodiment of the present invention, there is provided a composition, wherein the wherein molybdic acid monohydrate is present at a concentration of 1.5–3 g/l.

Additionally, in accordance with a preferred embodiment of the present invention, there is provided a composition, wherein the reducing agent is selected from dimethylamineborane (DMAB), sodium hydroborate, potassium hydroborate, sodium borohydride, potassium borohydride, a borazane, and borane pyridine complex.

Further, in accordance with a preferred embodiment of the present invention, there is provided a composition according to claim 10, wherein the borazane is of the formula $R_xNH_y.BH_{(x+y)}$, wherein x is an integer between 0 and 3, wherein y is an integer between 0 and 3, and wherein R is an organic group selected from methyl and ethyl.

Yet further, in accordance with a preferred embodiment of the present invention, there is provided a composition, wherein the reducing agent includes dimethylamineborane.

Also, in accordance with a preferred embodiment of the present invention, there is provided a composition, wherein the reducing agent includes a dimethylamineborane complex.

Further, in accordance with a preferred embodiment of the present invention, there is provided a composition, wherein the dimethylamineborane complex is present at a concentration of 5–20 g/l.

Additionally, in accordance with a preferred embodiment of the present invention, there is provided a composition, wherein the dimethylamineborane complex is present at a concentration of 7–12 g/l.

Also, in accordance with a preferred embodiment of the present invention, there is provided a composition, further including tetra-methyl ammonium hydroxide (TMAH) at a concentration of 50–100 g/l.

Further, in accordance with a preferred embodiment of the present invention, there is provided a composition according to claim 1, further including ammonium hydroxide.

Also, in accordance with a preferred embodiment of the present invention, there is provided a composition, wherein the ammonium hydroxide is at a concentration of less than 20 ml/l.

Additionally, in accordance with a preferred embodiment of the present invention, there is provided a composition, wherein the pH is between 8–12.

Further, in accordance with a preferred embodiment of the present invention, there is provided a composition, wherein the pH is between 9–11.

Yet further, in accordance with a preferred embodiment of the present invention, there is provided a composition, wherein the composition is adapted to produce a copper molybdenum deposit having at least one of the following properties:

(i) a change in reliability as defined by mean-time-to-failure during electro-migration testing of more than a factor of ten, (ii) a void density of less than $0.5/cm^2$, (iii) a grain boundary diffusion coefficient of less than $10^{-8.3} \cdot e^{-1.25\ ev/kT}$, (iv) a grain boundary diffusion coefficient, $D_o$ of $10^{-8.3}$ cm/s, and (v) a distribution of grain sizes having a standard deviation of less than 3 nm.

Further, in accordance with a preferred embodiment of the present invention, there is provided a composition, wherein the composition is adapted to electrolessly deposit copper molybdenum at a temperature of less than 60° C.

Also, in accordance with a preferred embodiment of the present invention, there is provided a composition, wherein the composition is adapted to electrolessly deposit copper molybdenum at a temperature of between 40° C. to about 50° C.

Additionally, in accordance with a preferred embodiment of the present invention, there is provided a composition, further including a surfactant.

Further, in accordance with a preferred embodiment of the present invention, there is provided a composition, wherein the surfactant includes at least one of RE-610 and Triton X-100.

There is thus provided in accordance with another preferred embodiment of the present invention an aqueous bath composition for the electroless deposition of copper molybdenum, including, in addition to water:

a soluble source of copper ions, a soluble source of molybdenum ions, a soluble source of citrate ions, and a reducing agent including boron, and wherein the composition is adapted to electrolessly produce a copper molybdenum deposit having a resistivity of less than 300 microohm.cm.

Furthermore, in accordance with a preferred embodiment of the present invention, there is provided a composition according to claim 26, wherein the soluble source of citrate ions includes sodium citrate.

Also, in accordance with a preferred embodiment of the present invention, there is provided a composition, wherein the copper molybdenum deposit has a resistivity of less than 100 microohm.cm.

Additionally, in accordance with a preferred embodiment of the present invention, there is provided a composition, wherein the composition is substantially devoid of alkali metals and alkaline earth metals.

Also, in accordance with a preferred embodiment of the present invention, there is provided a composition, wherein the soluble source of copper ions includes copper sulfate.

Also, in accordance with a preferred embodiment of the present invention, there is provided a composition, wherein the copper sulfate includes copper sulfate pentahydrate ($CuSO_4.5H_2O$) at a concentration of 2–10 g/l.

Further, in accordance with a preferred embodiment of the present invention, there is provided a composition, wherein the copper sulfate pentahydrate is at a concentration of 3–5 g/l.

Also, in accordance with a preferred embodiment of the present invention, there is provided a composition, wherein the source of molybdenum includes molybdic acid monohydrate($H_2MoO_4.H_2O$).

Furthermore, in accordance with a preferred embodiment of the present invention, there is provided a composition, wherein the wherein molybdic acid monohydrate is present at a concentration of 0–5 g/l.

Also, in accordance with a preferred embodiment of the present invention, there is provided a composition, wherein molybdic acid monohydrate is present at a concentration of 1.5–3 g/l.

Yet, in accordance with a preferred embodiment of the present invention, there is provided a composition, wherein the reducing agent is selected from sodium borohydride, potassium borohydride, borane pyridine complex and borazanes including but not limited to, dimethylamineborane (DMAB), borane triethylamine (TEAB), DMAB-complex and TEAB-complex.

Also, in accordance with a preferred embodiment of the present invention, there is provided a composition, wherein the borazane is of the formula $R_xNH_y.BH_{(x+y)}$, wherein x is an integer between 0 and 3, wherein y is an integer between 0 and 3, and wherein R is an organic group selected from methyl and ethyl Additionally, in accordance with a preferred embodiment of the present invention, there is provided a composition, wherein the reducing agent includes dimethylamineborane.

Also, in accordance with a preferred embodiment of the present invention, there is provided a composition, wherein the reducing agent includes a dimethylamineborane complex.

Further, in accordance with a preferred embodiment of the present invention, there is provided a composition, wherein the dimethylamineborane complex is present at a concentration of 5–20 g/l.

Yet further, in accordance with a preferred embodiment of the present invention, there is provided a composition according to claim 39, wherein the dimethylamineborane complex is present at a concentration of 7–12 g/l.

Additionally, in accordance with a preferred embodiment of the present invention, there is provided a composition, further including tetra-methyl ammonium hydroxide (TMAH) at a concentration of 50–100 g/l.

Also, in accordance with a preferred embodiment of the present invention, there is provided a composition, further including ammonium hydroxide.

Furthermore, in accordance with a preferred embodiment of the present invention, there is provided a composition, wherein the ammonium hydroxide is at a concentration of less than 20 ml/l.

Also, in accordance with a preferred embodiment of the present invention, there is provided a composition, wherein the pH is between 8–12.

Additionally, in accordance with a preferred embodiment of the present invention, there is provided a composition, wherein the pH is between 9–11.

Further, in accordance with a preferred embodiment of the present invention, there is provided a composition, wherein the composition is adapted to produce a copper molybdenum deposit having at least one of the following properties:

(i) a change in reliability as defined by mean-time-to-failure during electro-migration testing of more than a factor of ten, (ii) a void density of less than $0.5/cm^2$, (iii) a grain boundary diffusion coefficient of less than $10^{-8.3} \cdot e^{-1.25\ ev/kT}$, (iv) a grain boundary diffusion coefficient, $D_o$ of $10^{-8.3}$ cm/s, and (v) a distribution of grain sizes having a standard deviation of less than 3 nm.

Also, in accordance with a preferred embodiment of the present invention, there is provided a composition, wherein the composition is adapted to electrolessly deposit copper molybdenum at a temperature of less than 60° C.

Additionally, in accordance with a preferred embodiment of the present invention, there is provided a composition, wherein the composition is adapted to electrolessly deposit copper molybdenum at a temperature of between 40° C. to about 50° C.

Further, in accordance with a preferred embodiment of the present invention, there is provided a composition, further including a surfactant.

Also, in accordance with a preferred embodiment of the present invention, there is provided a composition, wherein the surfactant includes at least one of RE-610 and Triton X-100.

There is thus provided in accordance with a preferred embodiment of the present invention a copper molybdenum film electrolessly deposited on a surface from a bath including a composition mentioned hereinabove, and wherein a resistivity of the film is less than 10 microOhm.cm.

Also, in accordance with a preferred embodiment of the present invention, there is provided a copper molybdenum film, wherein the thickness of the film is less than approximately one micron.

Additionally, in accordance with a preferred embodiment of the present invention, there is provided a copper molybdenum film, wherein the thickness of the film is less than approximately 0.1 micron.

Further, in accordance with a preferred embodiment of the present invention, there is provided a copper molybdenum film, wherein a resistivity of the film is less than 8 microOhm.cm.

Also, in accordance with a preferred embodiment of the present invention, there is provided a copper molybdenum film, wherein the film includes 0–3% molybdenum.

Furthermore, in accordance with a preferred embodiment of the present invention, there is provided a copper molybdenum film, wherein the film includes 1–3% molybdenum.

Also, in accordance with a preferred embodiment of the present invention, there is provided a copper molybdenum film, wherein the film acts as a diffusion barrier for a metal on the surface, wherein the metal is selected from copper, gold, platinum, palladium, silver, nickel, cadmium, indium and aluminum.

Additionally, in accordance with a preferred embodiment of the present invention, there is provided a copper molybdenum film, wherein the film acts as an oxidation barrier.

Further, in accordance with a preferred embodiment of the present invention, there is provided a copper molybdenum film, wherein the film acts as a corrosion barrier.

There is thus provided in accordance with a preferred embodiment of the present invention a copper molybdenum film, electrolessly deposited on a surface from a bath including the composition mentioned herein, wherein a resistivity of the film is less than 300 microOhm.cm.

Also, in accordance with a preferred embodiment of the present invention, there is provided film, wherein the thickness of the film is less than approximately one micron.

Further, in accordance with a preferred embodiment of the present invention, there is provided a film, wherein the thickness of the film is less than approximately 0.1 micron.

Additionally, in accordance with a preferred embodiment of the present invention, there is provided a, wherein the resistivity of the film is less than 100 microOhm.cm.

Also, in accordance with a preferred embodiment of the present invention, there is provided a film, wherein the resistivity of the film is less than 10 microOhm.cm.

Further, in accordance with a preferred embodiment of the present invention, there is provided a film, wherein the film includes 0–3% molybdenum.

Also, in accordance with a preferred embodiment of the present invention, there is provided a film, wherein the film includes 1–3% molybdenum.

Additionally, in accordance with a preferred embodiment of the present invention, there is provided a film, wherein the film acts as a diffusion barrier for a metal on the surface, wherein the metal is selected from copper, gold, platinum, palladium, silver, nickel, cadmium, indium and aluminum.

Furthermore, in accordance with a preferred embodiment of the present invention, there is provided a film, wherein the film acts as an oxidation barrier.

Also, in accordance with a preferred embodiment of the present invention, there is provided a film, wherein the film acts as a corrosion barrier.

There is thus provided in accordance with a preferred embodiment of the present invention a method for the electroless deposition of copper molybdenum on a surface, including:

electrolessly depositing copper molybdenum on the surface, substantially in the absence of alkali metal ions so as to produce a copper molybdenum layer having a resistivity of less than 300 microohm.cm.

Additionally, in accordance with a preferred embodiment of the present invention, there is provided a method, wherein the resisitivity of the copper molybdenum layer is less than 100 microohm.cm.

Preferably, the resisitivity is less than 10 microohm.cm.

More preferably, the resisitivity is less than 8 microohm.cm.

Additionally, in accordance with a preferred embodiment of the present invention, there is provided a method further including activating the surface, and wherein activating the surface occurs at least partially under dry process conditions.

Further, in accordance with a preferred embodiment of the present invention, there is provided a method, wherein the surface includes silicon.

Furthermore, in accordance with a preferred embodiment of the present invention, there is provided a method, wherein the surface includes copper.

Yet further, in accordance with a preferred embodiment of the present invention, there is provided a method, wherein activating the surface further includes depositing at least one metal on the surface.

Furthermore, in accordance with a preferred embodiment of the present invention, there is provided a method, wherein the at least one metal is selected from aluminum, cobalt, copper and titanium.

Further, in accordance with a preferred embodiment of the present invention, there is provided a method further including removing at least partially some of the at least one metal.

Also, in accordance with a preferred embodiment of the present invention, there is provided a method, further including activating the surface, and wherein activating the surface occurs, at least partially, under wet process conditions.

Further, in accordance with a preferred embodiment of the present invention, there is provided a method, wherein activating the surface includes at least one of the following steps:

(a) degreasing the surface, (b) removing at least one oxide from the surface, (c) fluoride etching the surface, (d) rinsing the surface, (e) activating the surface with palladium, and (f) pre-dipping the surface in a solution including at least one of a reducing agent and a complexing agent.

Further, in accordance with a preferred embodiment of the present invention, there is provided a method, wherein electrolessly depositing includes electrolessly depositing a film having a thickness of less than approximately one micron.

Also, in accordance with a preferred embodiment of the present invention, there is provided a method, wherein the thickness of the film is less than approximately 0.1 micron.

Further, in accordance with a preferred embodiment of the present invention, there is provided a method, wherein the film includes 0–3% molybdenum.

Furthermore, in accordance with a preferred embodiment of the present invention, there is provided a method, wherein depositing the copper molybdenum is at a temperature of less than 60° C.

Also, in accordance with a preferred embodiment of the present invention, there is provided a method, wherein the temperature is from around 40° C. to 50° C.

Additionally, in accordance with a preferred embodiment of the present invention, there is provided a method, wherein depositing the copper molybdenum occurs at a pH of around 9 up to 11.

Further, in accordance with a preferred embodiment of the present invention, there is provided a method, wherein the pH is around 9.5 to 10.5.

There is thus provided in accordance with another preferred embodiment of the present invention method for the electroless deposition of copper molybdenum on a surface, including:

electrolessly depositing copper molybdenum on the surface in the presence of citrate ions so as to produce a copper molybdenum layer having a resistivity of less than 300 microohm.cm.

The present invention will be more fully understood from the following detailed description of the preferred embodiments thereof, taken together with the drawings, in which:

DETAILED DESCRIPTION OF PREFERRED EMBODIMENTS

Figure 1:
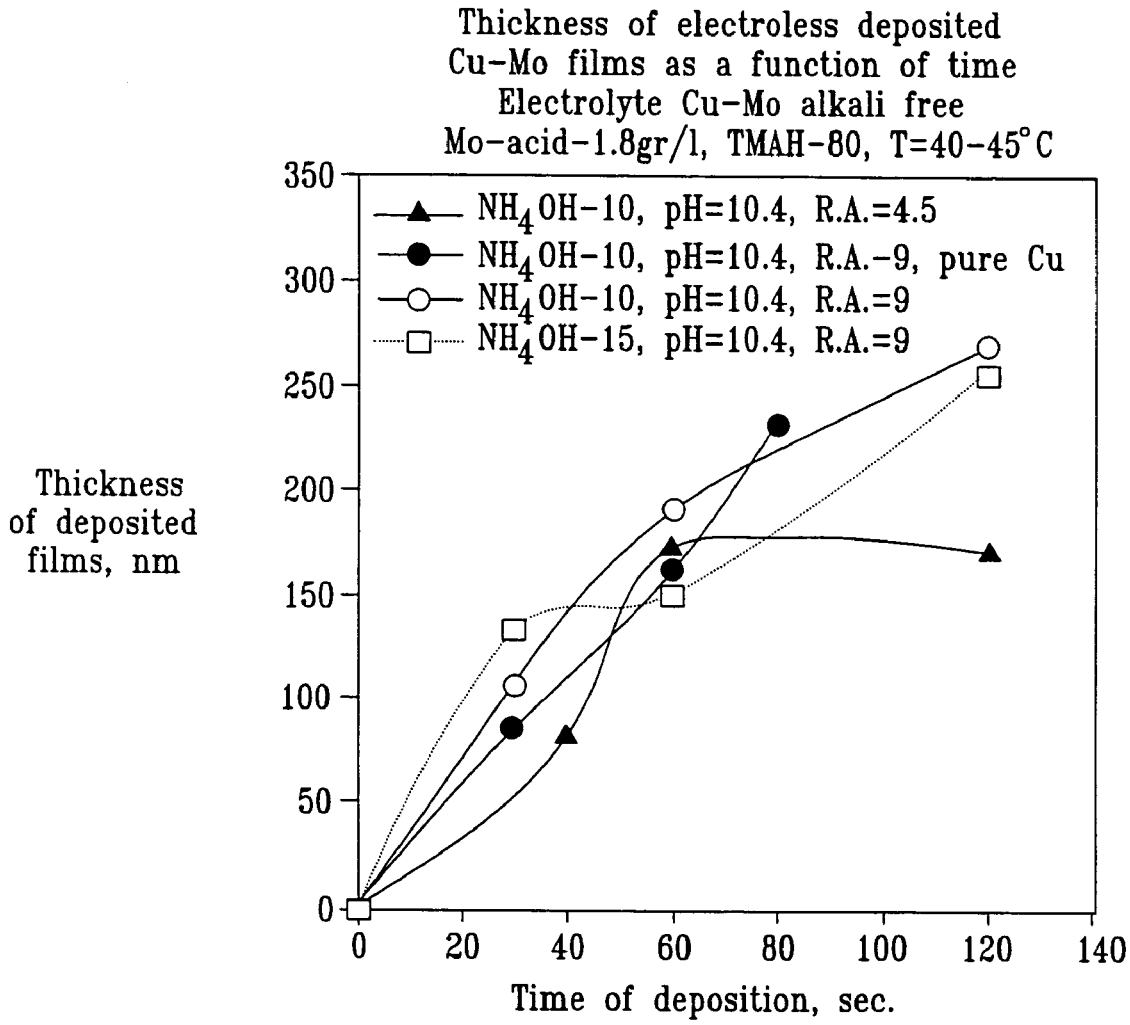
FIG. 1 is a graph of the thickness of electrolessly deposited Cu—Mo films from an alkali metal-free copper-molybdenum electrolyte as a function of time, in accordance with a preferred embodiment of the present invention.

Novel bath compositions for electroless deposition of copper and copper molybdenum are provided (Table 1).

A first bath composition appears in Table 1a. In contrast to the prior art bath compositions, this bath composition is substantially devoid of alkali metal ions.

A second bath composition (henceforth, "citrate bath or citrate electrolyte) for electroless deposition of copper and copper molybdenum appears in Table 1b.

TABLE 1

| Table 1a. Copper-molybdenum alkali metals free solution (CuMo-amf) | | | Table 1b. Copper-molybdenum citrate solution | | |
|---|---|---|---|---|---|
| | Concentration | | | Concentration | |
| Component | gr/l | mol/l | Component | gr/l | mol/l |
| $CuSO_4.5H_2O$ | 3 | 0.012 | $CuSO_4.5H_2O$ | 7.5 | 0.03 |
| $H_2MoO_4$ | 1.8 | 0.01 | $H_2MoO_4.H_2O$ | 1.8–5.4 | 0.01–0.03 |
| $EDTA_{[SL1]}$ | 6.6 | 0.023 | 3Na-citrate | 44.1 | 0.154 |
| TMAH | 80 | 0.88 | Oxalic acid | 1 | 0.008 |
| $NH_4OH$ | 5–10 ml/l | 0.035–0.07 | KOH | to pH = 7.7–7.9 | |
| Additives | 0.015 | | DMAB-complex | 9 | 0.15 |
| pH | 10–10.5 | | | | |
| Temperature | 40–50° C. | | pH | 7.7–7.9 | |
| DMAB-complex | 9 | 0.15 | Temperature | 55–60° C. | |

Copper molybdenum and copper layers of 40–300 nm layers were deposited from two novel aqueous electroless baths, whose composition and operating conditions appear hereinabove in Table 1. All the chemicals that were used were of analytical purity grade. All chemicals used were obtained from produced by MERCK, Darmstadt, Germany.

The copper molybdenum alkali metal-free solution (Table 1a comprises a copper sulfate solution containing ethylendiaminetetraacetic acid (EDTA) as a complexing agent and molybdic acid monohydrate as a source of molybdenum ions. The reducing agent was dimethylamine borane complex. The solution pH was typically 9.5 to 10.5. The operating temperature was typically in the range from 40° C. to 50° C. In our work this electrolyte was specified as CuMo-amf solution. The copper molybdenum citrate solution (Table 1b) comprises a copper sulfate-based solution with sodium citrate as a complexing agent and molybdic acid as a source of molybdenum ions. Dimethylamine borane complex is used as a reducing agent. The value of pH was in the range from 7.6 to 7.9. The working temperature was kept around 50° C.

EXAMPLE 1

Electroless Deposition of Films from Copper-Molybdenum Baths

Both baths (as in Table 1a and Table 1b) were used to deposit copper molybdenum on a surface as follows:

Silicon wafers were used as the underlayers in this investigation. The Cu—Mo films were deposited on ~1 $cm^2$ square single crystal silicon substrates that were cut from (100), 4" diameter, p-type, Si wafers with 10 Ω·cm resistivity and Si-epi wafers 1-0-0 with resistivity 8–20 Ω·cm. The samples were prepared as follows:

First, the wafers were degreased in hot (70–90° C.) $NH_4OH:H_2O_2$:DI water (1:1:6) by vol. for 5 min. to remove organic residues. Second, dipping in hot (70–90° C.) HCl: $H_2O_2$:DI water (1:1:5) by vol. for 5 min. to remove metallic oxides. Next, the samples were treated for 2 minutes at room temperature in a buffer solution of 48% HF:40% $NH_4F$ (1:10) by vol. to remove silicon dioxide. After that samples surface was activated in 11% $Na_2S_2O_3$ solution. Finally, the silicon surface was activated in Pd-activation solution The palladium activation solution is presented in Table 2

TABLE 2

| BATH COMPOSITION FOR PD ACTIVATION | |
|---|---|
| CHEMICALS | CONCENTRATION |
| $PdCl_2$ | 0.2 g/l |
| HCl | 2–10 ml/l |
| $CH_3COOH$ | 500 ml/l |
| HF | 5 ml/l |

The samples were rinsed in DI water after each step.

The basic bath properties, i.e. deposition rate, composition and resistivity for both bath compositions (as in Table 1a and Table 1b, were measured.

The thin-films deposited from both bath compositions were analyzed by X-Ray Photoemission Spectroscopy (XPS) and Auger Electron Spectroscopy (AES) methods in a Physical Electronics PHI model 590A tool.

The sheet resistance and resistivity of the deposited films were measured by In-Line-Four Point Probe and the thickness was determined by a Tencor—"Alpha-step 500" profilometer.

The topography and average height profiles were obtained by Digital Instruments atomic-force-microscope (AFM) (Auto Probe CP, Park Scientific Instrument). All reported measurements were carried out at room temperature.

In prior art studies (at pH>12), Mo-compounds were used for electroless deposition of copper as the stabilizer in parallel with Pb and Sn-ions, organic compounds of S, Se, Te, Tl and certain of organic acids. This means that the Mo acts as the inhibitor and escapes detection in copper solid.

It is known in the art that alloying of Cu with Mo is feasible in metallurgy. Thus, there should be a good chance of obtaining a copper-molybdenum deposit or layer by chemical (electroless) deposition. To attain electroless deposition, the value of pH is needs to be in the range 7–10. A very strong reducing agent such as DMAB, can be used for this purpose. Though experiments were performed employing several other reducing agents, it was found that copper molybdenum deposition process only took place in the presence of DMAB.

As a general rule, deposits obtained from baths with DMAB as a reducing agent contain boron. Without wishing to be bound by this theory, and without limiting this invention thereto, it is proposed that the reduction of boron is caused by the catalytic decomposition of reducing agent (equation 2) The hydrogen liberated at the cathode in process of Me-reducing (equation 1) favors the reducing of boron (equation 2).

The overall reaction of electroless Cu-deposition by the use of DMAB-complex as a reducing agent can be written as:

$$(CH_3)_2HN.BH_3+4H_2O+1.5Cu^{2+}\rightarrow 1.5Cu+1.5H_2+3H^++B(OH)^-_4+(CH_3)_2H_2N^+ \quad (1)$$

The decomposition of reducing agent can be described by the equation 2:

$$(CH_3)_2HN.BH_3+H^+\rightarrow BH_3+(CH_3)_2HN^+\rightarrow B^o+1.5H_2+(CH_3)_2H_2N^+ \quad (2)$$

It is seen that the atomic hydrogen generated by the reaction 1, releases as gas and does not take part in the reducing of copper. The electrolyte is acidified only by the protons of the water. In this invention, boron was not found by XPS and Auger methods in the deposited layers. It is thus probable that the concentration of boron in the deposited films was less than 0.01 atomic %.

Figure 3:
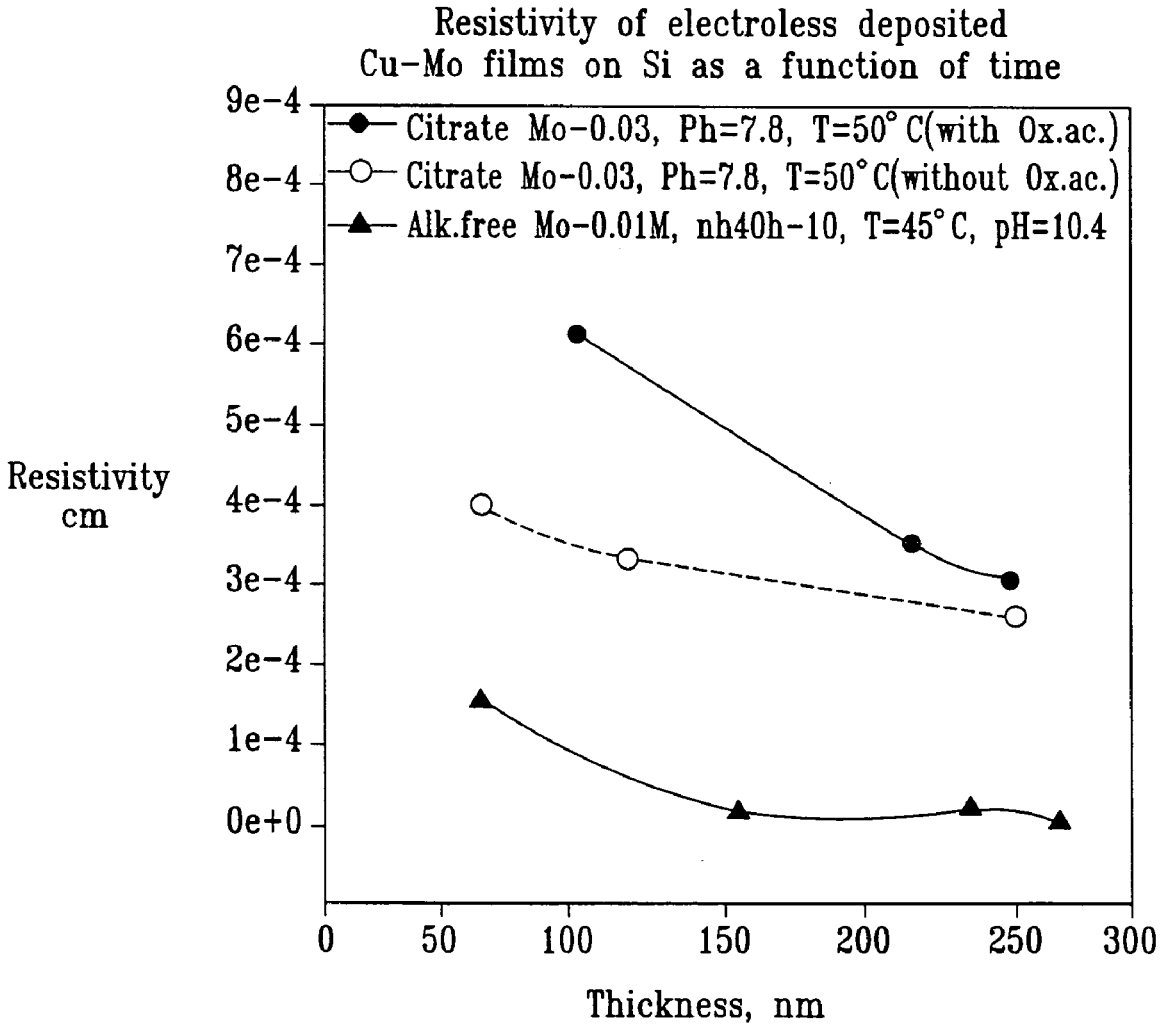
FIG. 3 shows SIMS profiles of electrolessly deposited Cu—Mo films obtained from an alkali metal-free copper-molybdenum electrolyte and from a copper-molybdenum citrate electrolyte, in accordance with preferred embodiments of the present invention.

The bath compositions (electrolytes) of the current invention are shown in Table 1. These electrolytes were tested on the feasibility to chemical deposit Cu—Mo films. Deposits were obtained from both aforementioned electrolytes. Copper-molybdenum films deposited from the alkali-metal-free solution were of significantly lower resistivity as compared to layers obtained from citrate solution (FIG. 3). Additionally, the copper molybdenum alkali metal-free electrolyte (Table 1a) was found to be more stable than citrate solution (Table 1b).

Figure 2:
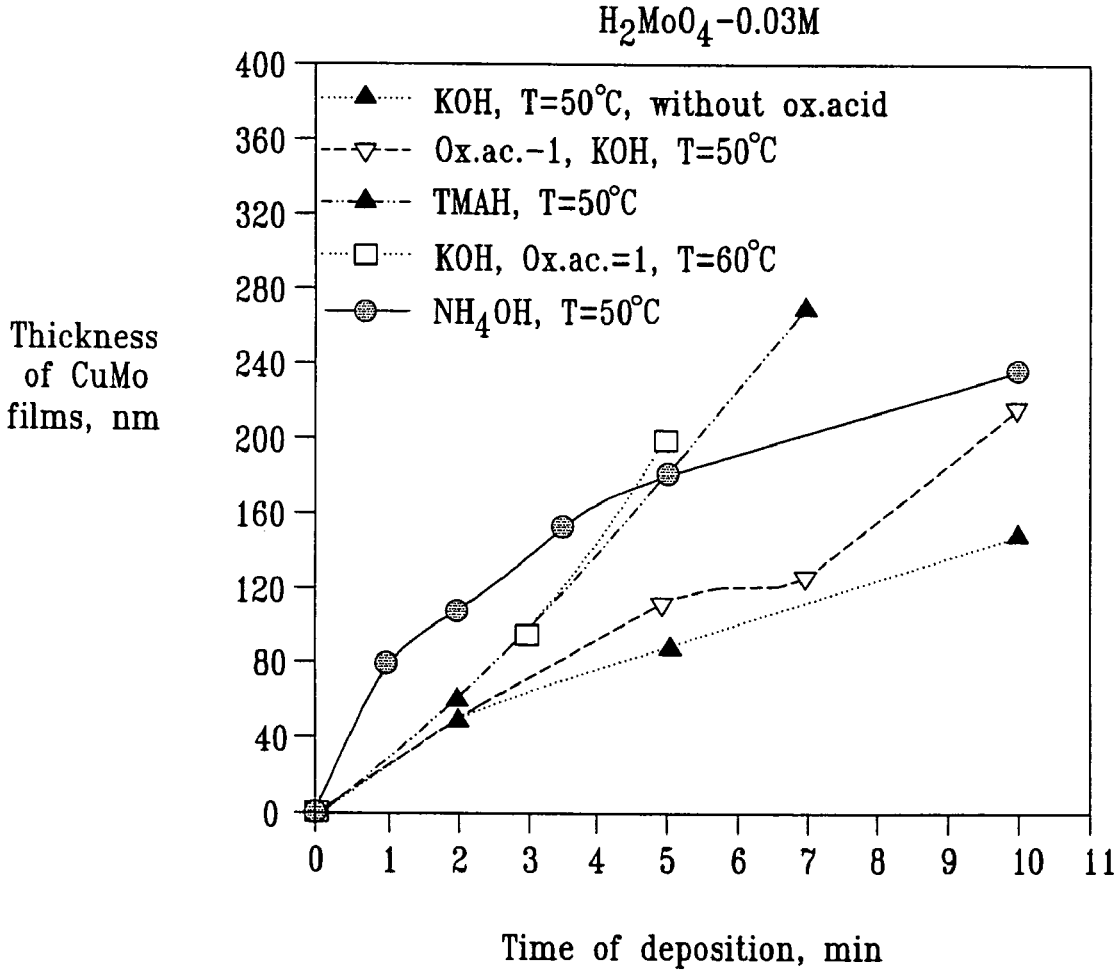
FIG. 2 is a graph of thickness of electrolessly deposited Co—Mo films from a copper-molybdenum citrate electrolyte as a function of time, in accordance with a preferred embodiment of the present invention.

It was also discovered that the addition of oxalic ions to citrate electrolyte (Table 1b) accelerated the reaction (FIG. 2).

Addition of ammonia at the rate of 5–15 ml/l to alkali metal-free solution of Table 1a, improved the stability of the electrolyte, possibly by complexing the copper. However, the concentration of molybdenum in the deposited solid decreased with the addition of ammonia to this electrolyte.

It was further found that the molybdenum concentration in the deposit goes down from 1.26 to 0.5 at. % at a pH of 10.5 with the concomitant addition of ammonia in amounts of 10 ml/l. This could be due to the strong complexing the molybdenum with ammonia. One key parameter for the process is pH value.

Employing the alkali metal-free solution without ammonia, the molybdenum content in the films was 1.26 at. % and 2.72 at. % at pH=10.5 and pH=9.5 respectively. It was noted that the deposition process at pH=9.5 proceed relatively very slowly.

Reference is now made to FIG. 1, which is a graph of the thickness of electrolessly deposited Cu—Mo films from an alkali metal-free copper-molybdenum electrolyte as a function of time.

Copper molybdenum deposits were deposited using the copper-molybdenum alkali metal-free solution (Table 1a). The thin film thickness was measured as a function of time. As can be seen from FIG. 1, the deposition rate of Cu—Mo layers is very nearly equal to deposition rate of pure Cu films from alkali metal-free solution, all factors being the same. The kinetics of deposition process was changed with changing of borohydride-dimethylamine-complex concentration in electrolyte. When the concentration of the reducing agent was halved, the film thickness reached a maximum of 150 nm after 1 min. of the deposition.

Reference is now made to FIG. 2, which a graph of thickness of electrolessly deposited Co—Mo films from a copper-molybdenum citrate electrolyte as a function of time.

FIG. 2 shows thickness of Cu—Mo films deposited from citrate bath with different source of hydroxyl ions: KOH, $NH_4OH$ and TMAH and with an $H_2MoO_4$ concentration of around the range of $0.03M_{[SL2]}$. It can be seen from FIG. 2, that deposition rate from this electrolyte with KOH is very slow. In this case, the deposition rate increases with adding of oxalic ions as catalyst to citrate solution with KOH. It can be seen that Cu—Mo films deposited from citrate electrolyte with KOH were better quality compared to Cu—Mo layers obtained from citrate baths with ammonia and TMAH-tetramethylammonium hydroxide$_{[SL3]}$.

Reference is now made to FIG. 3, which shows SIMS profiles of electrolessly deposited Cu—Mo films obtained from an alkali metal-free copper-molybdenum electrolyte and from a copper-molybdenum citrate electrolyte.

The resistivity of the deposited on Si substrate Cu—Mo films was measured by In-Line-Four Point Probe. FIG. 3 demonstrates resistivity of electroless deposited films on Si substrate from citrate and alkali metal-free baths as a function of layers thickness. In FIG. 3, it can be seen that resistivity of thin layers deposited from alkali metal-free solution is lower in comparison to resistivity of films obtained from citrate electrolyte. So, resistivity of Cu—Mo films 250 nm thick deposited from citrate bath was 270 μΩ.cm, resistivity of Cu—Mo layers 270 nm thick obtained from alkali metal-free bath was 7.2 μΩ.cm.

Figure 4:
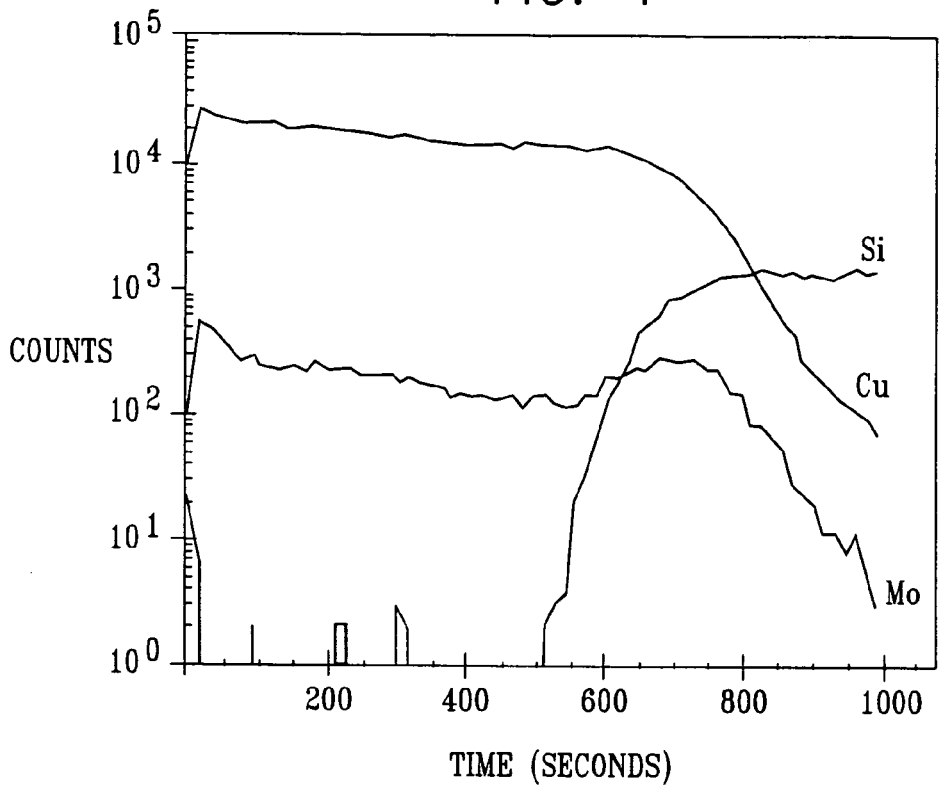
FIG. 4 is a SIMS profile of electrolessly deposited Cu—Mo films obtained from a copper-molybdenum citrate electrolyte, in accordance with a preferred embodiment of the present invention.
Figure 5:
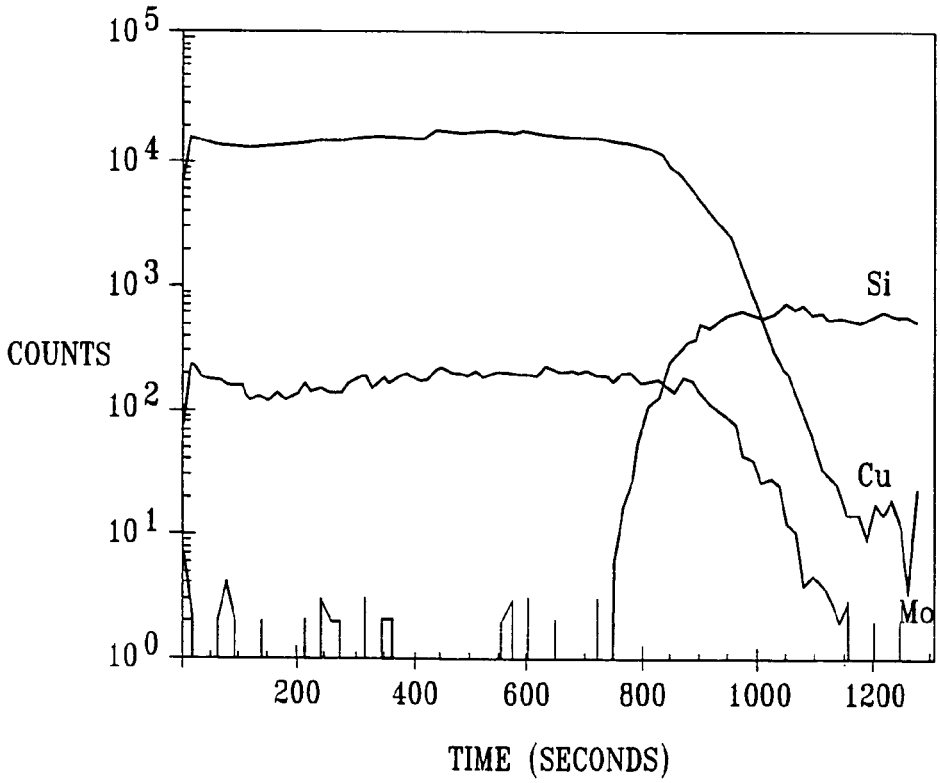
FIG. 5 is a SIMS profile of electrolessly deposited Cu—Mo films obtained from an alkali metal-free electrolyte, in accordance with a preferred embodiment of the present invention.

Reference is now made to FIG. 4, which is a SIMS profile of electrolessly deposited Cu—Mo films obtained from a copper-molybdenum citrate electrolyte. Reference is also made to FIG. 5, which is a SIMS profile of electrolessly deposited Cu—Mo films obtained from an alkali metal-free electrolyte.

The thin film compositions were measured by standard AES, XPS and SIMS methods, known in the art. FIGS. 4 and 5 show SIMS profile of electrolessly deposited thin Cu—Mo films, obtained from citrate and alkali metals free baths respectively. As can be seen from FIGS. 4, 5, molybdenum is evenly distributed across the deposited layers.

The molybdenum concentration in deposited films depends on the nature of electrolyte, value of pH and concentration of Mo-ions in deposition bath. The concentration of Mo-ions in alkali metal-free bath was 0.01M. Concentration of molybdenum in deposit depends on pH-value and the availability of ammonia in solution. It was found that the molybdenum concentration in films obtained from alkali metal-free electrolyte without ammonia was 1.26 atomic percent at a pH of 10.5, and 2.72 atomic percent at a pH of 9.5.

The molybdenum concentration in solids deposited at pH=10.5 from the alkali metal-free [SL4]electrolyte without ammonia was 1.26 atomic percent and from solution with ammonia (10 m/l) was 0.5 atomic percent. The relative amount of molybdenum in the solid obtained from alkali metal-free bath at a pH of 10.5 is 0.5 atomic percent and 1.2 atomic percent for electrolytes without and with ammonia respectively.

The concentration of molybdenum ions in citrate bath was provided in a range of from 0.01 to 0.03 M. The content of molybdenum in the solid deposited from the citrate electrolyte increases moderately with increasing of molybdenum ions concentration in the electrolyte.

Figure 11:
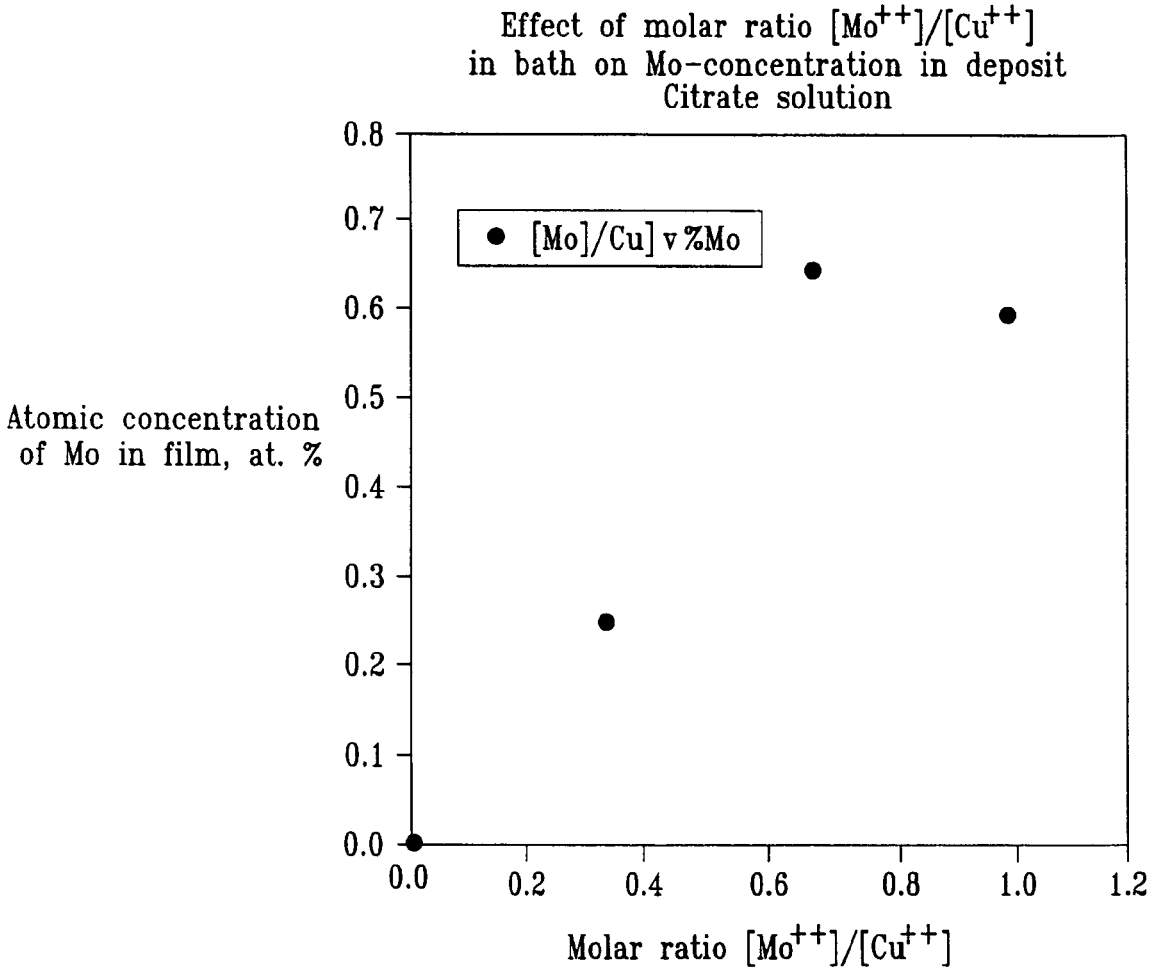

Reference is now made to FIG. 11, which is a graph showing the effect of the molar ratio $[Mo^{++}]/[Cu^{++}]$ in an electrolyte on the molybdenum concentration in the solid produced from a citrate electrolyte.

As is shown in FIG. 11, molybdenum ion concentration in film increases from 0.25 atomic percent to 0.65 atomic percent as the molybdenum ion concentration in bath increases from 0.01M to 0.02 M. Further increasing of Mo-content in electrolyte has no effect on Mo-concentration in the deposit.

As the concentration of Mo-ions in the bath increases from 0.02 M to 0.03 M the concentration of Mo in film reached a maximum of 0.65 atomic percent.

Figure 6:
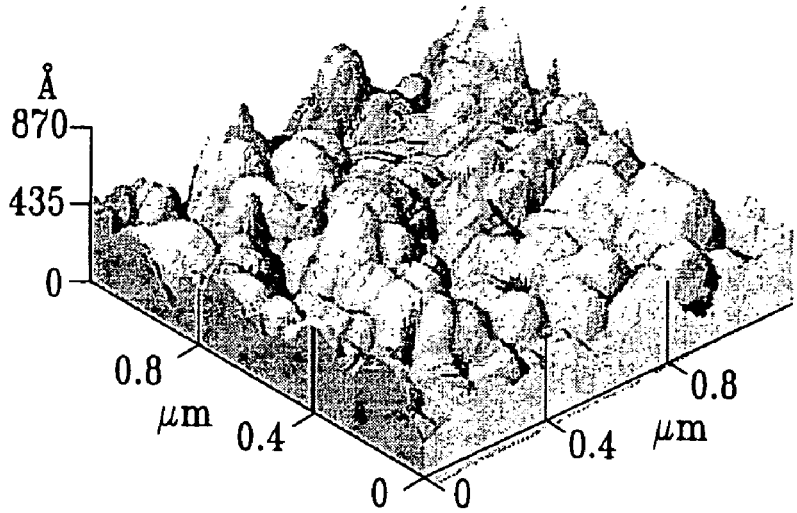
FIG. 6 is an AFM image of electrolessly deposited pure Cu film from alkali metal free bath, in accordance with a preferred embodiment of the present invention.

Reference is now made to FIG. 6, which is an AFM image of electrolessly deposited pure Cu film from alkali metal free bath.

Figure 7:
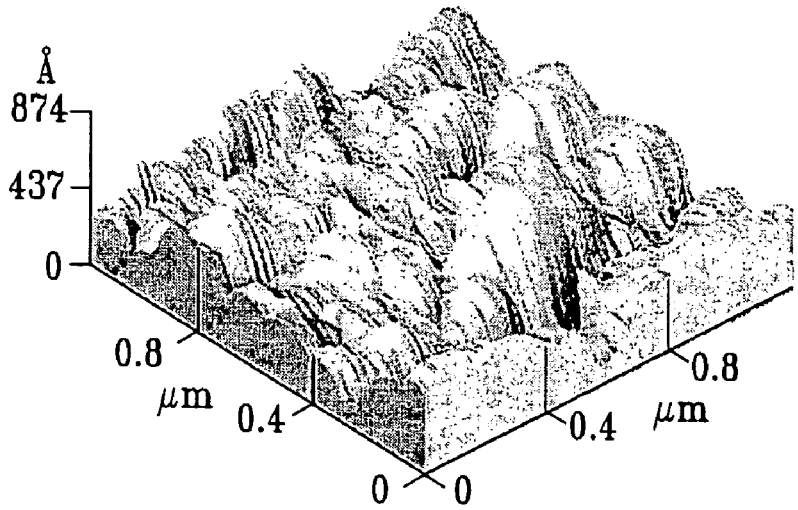
FIG. 7 is an AFM image of electrolessly deposited Cu—Mo film from a citrate bath with oxalic acid (1 g/l), in accordance with a preferred embodiment of the present invention.

Reference is also made to FIG. 7, which is an AFM image of electrolessly deposited Cu—Mo film from a citrate bath with oxalic acid (1 g/l).

Figure 8:
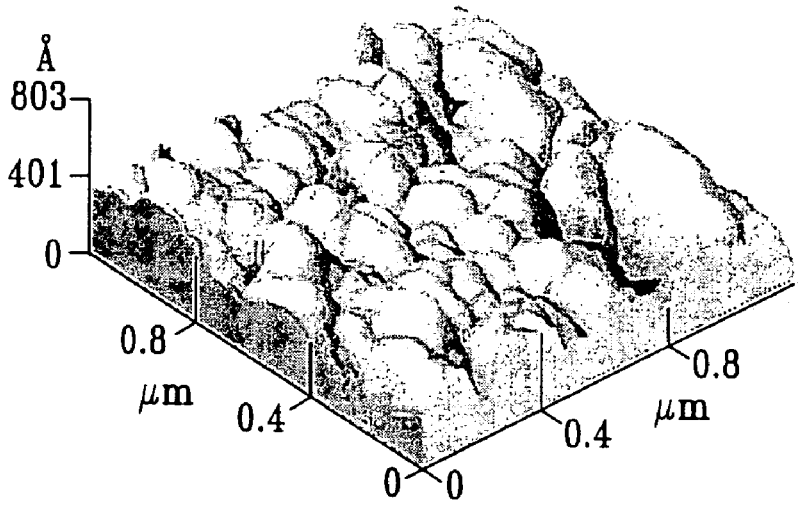
FIG. 8 is an AFM image of electrolessly deposited Cu—Mo film from an alkali metal-free solution, in accordance with a preferred embodiment of the present invention.

Further reference is made to FIG. 8, which is an AFM image of electrolessly deposited Cu—Mo film from an alkali metal-free solution.

Figure 9:
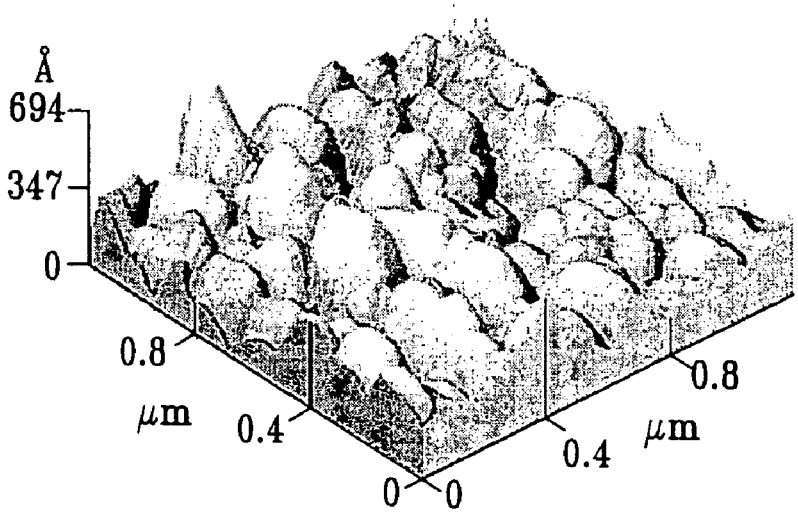
FIG. 9 is an AFM image of electrolessly deposited Cu—Mo film from an alkali metal-free solution comprising 10 ml/l ammonia, in accordance with a preferred embodiment of the present invention.
Figure 10A:
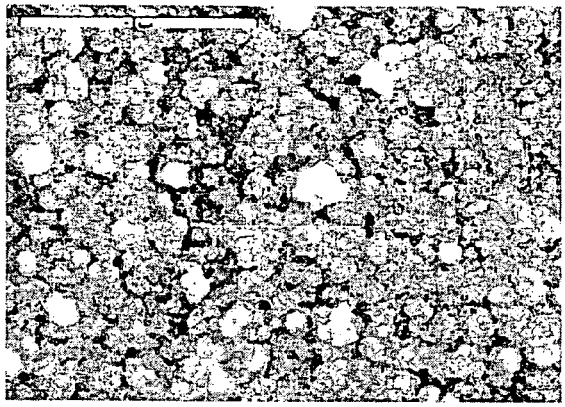
FIG. 10*a*–10*d* are SEM micrographs of the electrolessly deposited films: (a) pure Cu from alkali metal-free solution, (b) Cu—Mo layer from citrate bath, (c) Cu—Mo layer from alkali metal-free solution without ammonia, (d) Cu—Mo layer from alkali metal-free solution with ammonia, in accordance with preferred embodiments of the present invention; and, FIG. 11 is a graph showing the effect of the molar ratio $[Mo^{++}]/[Cu^{++}]$ in an electrolyte on the molybdenum concentration in the solid produced from a citrate electrolyte, in accordance with a preferred embodiment of the present invention.
Figure 10B:
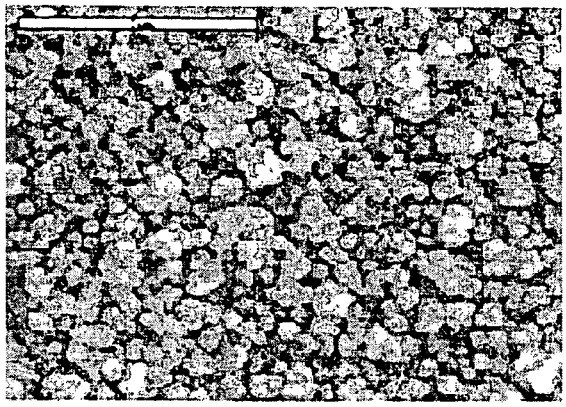
Figure 10C:
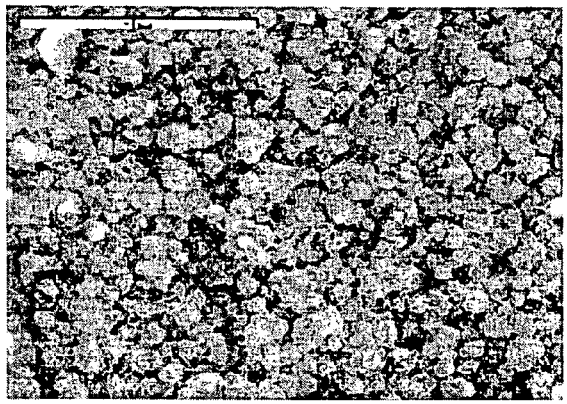
Figure 10D:
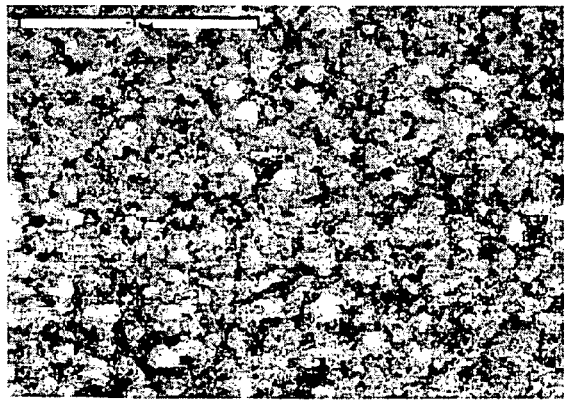

Reference is additionally made to FIG. 9, which is an AFM image of electrolessly deposited Cu—Mo film from an alkali metal-free solution comprising 10 ml/l ammonia.

FIGS. 6–9 show the results of a surface scanning study of copper and copper-molybdenum layers deposited from both electrolytes (as in Table 1a and 1b) by atomic force microscopy (AFM). The thickness of such films was in the range of 120–150 nm. FIGS. 6–9 demonstrate the AFM images of Cu and Cu—Mo films deposited on Si substrate.

It can be seen that the surface differences are of minor nature and are determined by the character of first seed.

Reference is now made to FIGS. 10*a*–10*d*, which are SEM micrographs of the electrolessly deposited films: (a) pure Cu from alkali metal-free solution, (b) Cu—Mo layer from a citrate bath, (c) Cu—Mo layer from alkali metal-free solution without ammonia, (d) Cu—Mo layer from alkali metal-free solution with ammonia.

The copper and copper-molybdenum films deposited from both electrolytes differ significantly in their morphology as observed by scanning electron microscopy (SEM). Typical SEM top views of deposits are shown in FIGS. 10*a*–10*d*. As can be seen, the general view of the films being studied is very similar. It should be noted, that the islands size of the deposits decreased moderately from FIG. 10*a* to FIG. 10*d*.

Copper-molybdenum (CuMo) thin layers were deposited on Si substrate using the electroless (chemical) method from both electrolytes: citrate and alkali metal-free. The film morphology of obtained layers was studied by SEM and AFM. Compared to electroless deposited pure copper, copper-molybdenum deposits have smaller grains. Resistivity of as deposited Cu—Mo thin films on Si substrate was very high. The resistivity of Cu—Mo layers thicker than 270 nm were about 7 μΩ.cm for alkali metals free solution. Resistivity of pure copper for 170 nm thick was 16 μΩ.cm for this electrolyte. Except that the resistivity were much higher for thinner layers deposited from alkali metals free solution. Resistivity of Cu—Mo films obtained from citrate bath was about 160 μΩ.cm.

Vacuum annealing allows to improve the resistivity of the deposited from citrate bath copper-molybdenum films with an order of magnitude. Resistivity of obtained from alkali metal-free bath copper-molybdenum films was unaltered after vacuum annealing.

Copper-molybdenum electrolytes are not very stable. Introducing of stabilizer into solution improves its stability and decreases the molybdenum concentration in films at one time. The molybdenum ions act as very strong inhibitors for copper electroless deposition process. Oxygen content in deposited films is very high but it decreases after annealing in vacuum at 340° C. for 1 h. Consequently, copper-molybdenum layers may be used for on-chip interconnects as alternatives to copper.

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art, which would occur to persons skilled in the art upon reading the foregoing description.

The invention claimed is:

1. An aqueous bath composition for the electroless deposition of copper molybdenum, comprising, in addition to water:

a soluble source of copper ions;

a soluble source of molybdenum ions; and a reducing agent comprising boron;

wherein said composition is adapted to electrolessly produce a copper molybdenum deposit having a resistivity of less than 30 microohm.cm, and wherein said soluble source of molybdenum ions comprises molybdic acid monohydrate ($H_2MoO_4.H_2O$).

2. A composition according to claim 1, wherein said copper molybdenum deposit has a resistivity of less than 10 microohm.cm.

3. A composition according to claim 1, wherein said composition is substantially devoid of alkali metals and alkaline earth metals.

4. A composition according to claim 1, wherein said soluble source of copper ions comprises copper sulfate.

5. A composition according to claim 4, wherein said copper sulfate comprises copper sulfate pentahydrate ($CuSO_4.5H_2O$) at a concentration of 2–10 g/l.

6. A composition according to claim 5, wherein said copper sulfate pentahydrate is at a concentration of 3–5 g/l.

7. A composition according to claim 1, wherein said molybdic acid monohydrate is present in said composition at a concentration of 0–5 g/l.

8. A composition according to claim 7, wherein said molybdic acid monohydrate is present at a concentration of 1.5–3 g/l.

9. A composition according to claim 1, wherein the reducing agent is selected from the group consisting of sodium borohydride, potassium borohydride, borane pyridine complex and a borazane selected from the group consisting of dimethylamineborane (DMAB), borane triethylamine (TEAB), DMAB-complex and TEAB-complex.

10. A composition according to claim 9, wherein said borazane is of the formula $R_xNH_y.BH_{(x+y)}$, wherein x is an integer between 0 and 3, wherein y is an integer between 0 and 3, and wherein R is an organic group selected from the group consisting of methyl and ethyl.

11. A composition according to claim 9, wherein the reducing agent comprises dimethylamineborane.

12. A composition according to claim 11, wherein the reducing agent comprises a dimethylamineborane.complex.

13. A composition according to claim 12, wherein said dimethylamineborane complex is present at a concentration of 5–20 g/l.

14. A composition according to claim 13, wherein said dimethylamineborane complex is present at a concentration of 7–12 g/l.

15. A composition according to claim 10, further comprising tetra-methyl ammonium hydroxide (TMAH) at a concentration of 50–100 g/l.

16. A composition according to claim 1, further comprising ammonium hydroxide.

17. A composition according to claim 16, wherein said ammonium hydroxide is at a concentration of less than 20 ml/l.

18. A composition according to claim 1, wherein the pH is between 8–12.

19. A composition according to claim 18, wherein the pH is between 9–11.

20. A composition according to claim 1, wherein said composition is adapted to produce a copper molybdenum deposit having at least one of the following properties:

(i) a change in reliability as defined by mean-time-to-failure during electro-migration testing of more than a factor of ten;

(ii) a void density of less than $0.5/cm^2$;

(iii) a grain boundary diffusion coefficient of less than $10^{-8.3}$. $e^{-1.25\ ev/kT}$;

(iv) a grain boundary diffusion coefficient, $D_o$ of $10^{-8.3}$ cm/s; and (v) a distribution of grain sizes having a standard deviation of less than 3 nm.

21. A composition according to claim 1, wherein said composition is adapted to electrolessly deposit copper molybdenum at a temperature of less than 60° C.

22. A composition according to claim 21, wherein said composition is adapted to electrolessly deposit copper molybdenum at a temperature of between 40° C. to about 50° C.

23. A composition according to claim 1, further comprising a surfactant.

24. A composition according to claim 23, wherein said surfactant comprises at least one of Polyoxyethylene Alkyl Phenol Phosphate Ester and $C_{14}H_{22}O(C_2H_4O)_n$ having an average number of ethylene oxide units per molecule of 9–10.

25. An aqueous bath composition for the electroless deposition of copper molybdenum, comprising, in addition to water:

a soluble source of copper ions;

a soluble source of molybdenum ions;

a soluble source of citrate ions; and a reducing agent comprising boron; and wherein said composition is adapted to electrolessly produce a copper molybdenum deposit having a resistivity of less than 300 microohm.cm, and wherein said source of molybdenum comprises molybdic acid monohydrate($H_2MoO_4.H_2O$).

26. A composition according to claim 25, wherein said soluble source of citrate ions comprises sodium citrate.

27. A composition according to claim 25, wherein said copper molybdenum deposit has a resistivity of less than 100 microohm.cm.

28. A composition according to claim 25, wherein said composition is substantially devoid of alkali metals and alkaline earth metals.

29. A composition according to claim 24, wherein said soluble source of copper ions comprises copper sulfate.

30. A composition according to claim 29, wherein said copper sulfate comprises copper sulfate pentahydrate ($CuSO_4.5H_2O$) at a concentration of 2–10 g/l.

31. A composition according to claim 30, wherein said copper sulfate pentahydrate is at a concentration of 3–5 g/l.

32. A composition according to claim 25, wherein said molybdic acid monohydrate is present in said composition at a concentration of 0–5 g/l.

33. A composition according to claim 32, wherein said molybdic acid monohydrate is present at a concentration of 1.5–3 g/l.

34. A composition according to claim 25, wherein the reducing agent is selected from the group consisting of dimethylamineborane (DMAB), sodium hydroborate, potassium hydroborate, sodium borohydride, potassium borohydride, a borazane, and borane pyridine complex.

35. A composition according to claim 34, wherein said borazane is of the formula $R_xNH_y.BH_{(x+y)}$, wherein x is an integer between 0 and 3, wherein y is an integer between 0 and 3, and wherein R is an organic group selected from the group consisting of methyl and ethyl.

36. A composition according to claim 25, wherein the reducing agent comprises dimethylamineborane.

37. A composition according to claim 36, wherein the reducing agent comprises a dimethylamineborane complex.

38. A composition according to claim 37, wherein said dimethylamineborane complex is present at a concentration of 5–20 g/l.

39. A composition according to claim 37, wherein said dimethylamineborane complex is present at a concentration of 7–12 g/l.

40. A composition according to claim 25, further comprising tetra-methyl ammonium hydroxide (TMAH) at a concentration of 50–100 g/l.

41. A composition according to claim 25, further comprising ammonium hydroxide.

42. A composition according to claim 41, wherein said ammonium hydroxide is at a concentration of less than 20 ml/l.

43. A composition according to claim 25, wherein the pH is between 8–12.

44. A composition according to claim 43, wherein the pH is between 9–11.

45. A composition according to claim 25, wherein said composition is adapted to produce a copper molybdenum deposit having at least one of the following properties:

(i) a change in reliability as defined by mean-time-to-failure during electro-migration testing of more than a factor of ten;

(ii) a void density of less than $0.5/cm^2$;

(iii) a grain boundary diffusion coefficient of less than $10^{-8.3}$. $e^{-1.25\ ev/kT}$;

(iv) a grain boundary diffusion coefficient, $D_o$ of $10^{-8.3}$ cm/s; and (v) a distribution of grain sizes having a standard deviation of less than 3 nm.

46. A composition according to claim 25, wherein said composition is adapted to electrolessly deposit copper molybdenum at a temperature of less than 60° C.

47. A composition according to claim 46, wherein said composition is adapted to electrolessly deposit copper molybdenum at a temperature of between 40° C. to about 50° C.

48. A composition according to claim 25, further comprising a surfactant.

49. A composition according to claim 48, wherein said surfactant comprises at least one of Polyoxyethylene Alkyl Phenol Phosphate Ester and $C_{14}H_{22}O(C_2H_4O)_n$ having an average number of ethylene oxide units per molecule of 9–10.

* * * * *